United States Patent [19]

Marier

[11] 4,063,422

[45] Dec. 20, 1977

[54] CONNECTOR STRUCTURE

[76] Inventor: Gaston Marier, P.O. Box 549, Princeville, Quebec, Canada

[21] Appl. No.: 684,362

[22] Filed: May 7, 1976

Related U.S. Application Data

[63] Continuation of Ser. No. 558,811, March 17, 1975, abandoned.

[30] Foreign Application Priority Data

Nov. 20, 1974 Brazil ..... 9710

[51] Int. Cl.[2] ..... E02D 5/34

[52] U.S. Cl. ..... 61/53; 61/56; 403/305; 403/321; 403/379

[58] Field of Search ..... 61/53, 56, 53.5, 46.5, 61/52.5; 285/330, 18, 305, 321; 403/329, 32 G, 305, 321; 52/722

[56] References Cited

U.S. PATENT DOCUMENTS

| | | | |
|---|---|---|---|
| 1,442,223 | 1/1923 | Knebusch | 403/326 |
| 2,597,482 | 5/1952 | Harrison et al. | 61/53 X |
| 3,422,630 | 1/1969 | Marier | 61/53 |
| 3,585,803 | 6/1971 | Bardgette | 61/53 |

*Primary Examiner*—Jacob Shapiro

*Attorney, Agent, or Firm*—Diller, Brown, Ramik & Wight

[57] ABSTRACT

A connector structure comprising a first connector element for securement to the end of a post-like structure, and a second connector element for securement to a further structure. One of the connector elements has a flange with a groove about an inner connecting side wall thereof. The other connector has a projection portion with a groove about an outer connecting side wall thereof. The projection portion is dimensioned for close fit within an inner recess area formed within the area defined by the flange. With the projection portion positioned within the said area, the grooves are juxtaposed to define an endless locking channel. At least one access passage extends through the flange to join the locking channel tangentially to permit passage and insertion of a locking rod at least in a substantial portion of the locking channel. The rod has a cross-section for close fit into the locking channel whereby it can be fitted in the channel through the access passage to lock the connectors from separation. The locking rod provides load transfer, resulting from a load applied axially of the structures, between opposed faces thereof in the axial direction.

6 Claims, 4 Drawing Figures

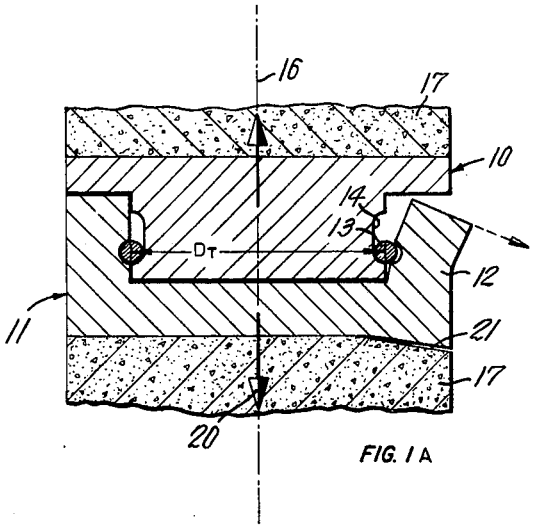
PRIOR ART.
FIG. 1A
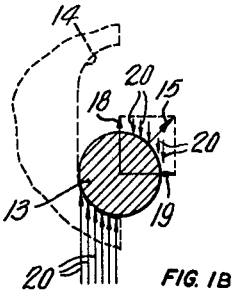
FIG. 1B
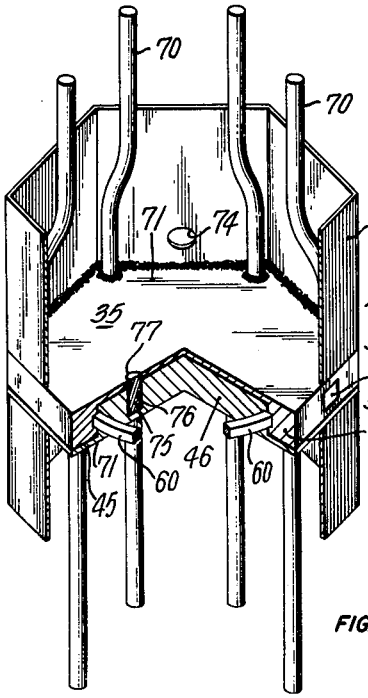
FIG. 3
FIG. 2
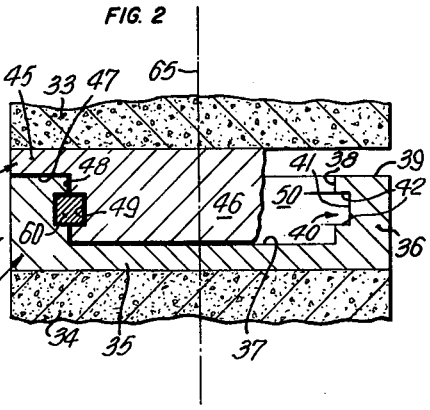

CONNECTOR STRUCTURE

This is a continuation of application Ser. No. 558,811, filed Mar. 17, 1975 now abandoned.

BACKGROUND OF THE INVENTION

A. Field of the Invention

The present invention relates to a connector structure and more particularly, but not exclusively to a connector for locking adjacent ends of concrete pile sections.

B. Description of the Prior Art

The present invention relates to an improved connector structure of the type as disclosed in my U.S. Pat. No. 3,422,630 issued Jan. 21, 1969 and entitled "Concrete Pile Construction". The state of the art in the last few years and relating to concrete pile construction has been quite stable in that these piles have remained substantially of the same type construction, being circular or hexagonal in cross-section and being formed of reinforced concrete. To date, there are only two connector joints known to the Applicant, one of which is that as disclosed in my above-mentioned U.S. Pat. and the other as disclosed in U.S. Pat. No. 3,104,532.

From a further analysis and experimentation of such connector structures, it has been found that various problems exist with these type joints. For example, it has been found that the locking rods of circular cross-section in the locking joint have a tendency to fail when the flange section of the female connector is not of sufficient thickness. When the joint is subjected to a traction load, the load distribution on the locking rod gives a resultant load component which is at an angle relative to the longitudinal axis of the pile for the reason that the locking rod is of a circular cross-section. From a vector analysis, it can be seen that a force acting downwardly, transverse to the longitudinal axis of the locking rod, would have a resultant vector substantially oriented towards 45° to the said vertical axis. This resultant force is a force which is lost and which can also be damaging to the joint structure.

SUMMARY OF THE INVENTION

It is therefore a feature of the present invention to provide a connector structure in which a locking rod is provided to substantially overcome the above-mentioned disadvantage.

It is a further feature to provide an improved connector structure for concrete pile connection which is substantially stronger than that heretofore known.

It is a further feature to provide a connector structure which may be used to connect any type of post-like elements into a ground anchorage structure whereby the support post-like structure can be easily replaced when damaged or when necessary for other reasons.

According to the above features, from a broad aspect, the present invention provides a connector structure for interconnecting elongated pile sections comprising a first connector element for securement to the end of a pile section, a second connector element for securement to a further pile section, one of said connectors having a plate for attachment to one of said sections, an annular flange located on and extending above a surface of said plate to define a connecting inner side wall, a flat top surface on said flange, an inner recess area defined by said flange and having a flat bottom wall, a groove mid-way about said inner connecting side wall, the other of said connectors having a further plate for attachment to said other one of said sections; a projection portion extending above a surface of said further plate and having a flat top surface, said projection portion being of the same thickness as the height of said annular flange and defining a connecting outer side wall, a groove mid-way about said outer side wall, said projection portion being dimensioned for close fit within said inner recess area with said grooves juxtaposed and said flat top surface of said projection portion in abutment with said recess area bottom wall, said juxtaposed grooves defining an endless locking channel, at least one access passage extending through said flange to join said locking channel tangentially to permit passage and insertion of a locking rod at least in a substantial portion of said locking channel, said rod having a rectilinear cross-section for close fit into at least one of said grooves of said locking channel whereby it can be fitted in said channel through said access passage to lock the connectors from separation, said locking rod and said channel being of rectilinear cross-section and having opposed parallel top and bottom surfaces disposed transversely to the longitudinal axis of the pile and parallel side surface extending parallel to said longitudinal axis to provide axial load transfer resulting from a load applied axially of said pile sections and acting between said opposed parallel faces of said rod in said axial direction.

BRIEF DESCRIPTION OF THE DRAWINGS

The invention will now be described with reference to the accompanying drawings in which:

FIG. 1A is a fragmented sectional view of a joint connector for connecting ends of concrete pile sections, as is known in the prior art;

FIG. 1B is a cross-sectional view showing a vector analysis of the forces applied on a circular locking rod, as is known in the prior art;

FIG. 2 is a sectional view illustrating the joint connector structure of the present invention; and FIG. 3 is a fragmented perspective view of the joint connector structure of the present invention.

DESCRIPTION OF THE PREFERRED EMBODIMENT

Referring now to the drawings, and more particularly to FIGS. 1A and 1B, there is illustrated a joint structure of the prior art and the locking rod thereof. FIG. 1A illustrates the manner in which the joint formed by the male connector 10 and the female connector 11, fails when the joint is subjected to a traction force. As shown, the male connector and female connector are interlocked together by a locking rod 13 which is disposed in a locking channel 14 formed by opposite annular grooves provided in a vertically extending side wall of both connectors. FIG. 1B is a vector analysis of the distribution of forces acting on the locking rod 13 when the joint is subjected to a traction force. It can be seen that the resultant force, illustrated by vector 15, is inclined relative to the longitudinal axis 16 of the pile section 17 which are interconnected by the male and female connector. The vector 18 represents the force applied axially of the pile sections 17, whilst the vector 19 represents an unwanted force which is destructive and also not recuperable. If it was possible to redistribute the force represented by vector 19 in a tangential or axial manner, the joint would not fail in the manner as illustrated in FIG. 1A.

The arrows 20 indicate the direction of the force applied against the locking rod 13 and the vectors illustrate the distribution of the forces by the locking rod. As can be seen in FIG. 1A, the rod will apply an outward pressure against the flange section 12 of the female joint 11, causing the joint 11 to be displaced outwardly to cause the failure. The outward displacement of the flange 12 will also cause a compressed zone 21 about the periphery of the pile section 17 where it is connected to the female connector. The result it that the joint is disconnected and destroyed and the repair of such a joint after a section of pile has been inserted in the ground is very difficult and time consuming.

The above disadvantage has been substantially overcome by the provision of a square or rectangular locking rod positioned in an interlocking channel formed between the male and female connector which is a cross-section of the same configuration as the locking rod. The tolerances between the rod and the walls of the locking channel is very small whereby a slight inclination of the locking rod in the channel will not cause any radial force which is considered damaging.

Referring now to FIGS. 2 and 3, there is shown, generally at 30, the connector structure of the present invention. The connector 30 comprises a first connector element, herein a female connector 31, and a second connector element 32, herein a male connector. The male and female connectors are connected to an end of a respective pile section 33 and 34. The female connector 31 consists essentially of a flat metal plate 35 which is attached to the end of the pile section 34. An annular flange 36 is rigidly connected about the outer periphery of the plate 35 and extends above a flat outer surface 37 thereof. The flange 36 defines a connecting inner side wall 38 extending perpendicular to the flat wall 37. The area within the annular flange 36 and above the flat surface 37 is herein defined as an inner recess area having a flat bottom wall, which wall is the surface 37. The flange 36 further has a flat top surface 39. A groove 40 is provided about the inner connection side wall 38 and is defined by two parallel opposed endless side walls 42 and a bottom wall 41. The groove 40 is of substantially rectangular cross-section.

The male connector 32 also comprises a flat metal plate for attachment to the end of the pile section 33. A metallic projection portion 46 is secured to the flat top surface 47 of the plate 45. The projection portion is secured by suitable means such as welding or bolting the portion onto plate 45. The projection portion 46 has a height or thickness which is substantially identical to the height or thickness of the annular flange 36 from the top surface 37 of the plate 31. The projection portion also defines a connecting outer side wall 48 with a groove 49 formed about this side wall. The groove 49 is of the same cross-section as the groove 40. The projection portion 46 is dimensioned for close fit within the inner recess area 50 and both of the grooves 40 and 49 are juxtaposed when the projection portion 46 is positioned within the recess area 50.

The juxtaposed grooves 40 and 49 define an endless locking channel having opposed parallel side walls, which are defined by the walls of the juxtaposed grooves. At least one access passage 55 extends through the flange 36 to join the locking channel tangentially to permit passage and insertion of a locking rod 60, at least in a substantial portion therein. The rod 60 is constructed of a suitable material, herein steel, and has cross-section of the same configuration as the locking channel but only slightly smaller whereby the rod 60 will not be caused to incline in the channel when the joint is subjected to a traction force, as described hereinabove. With the locking rod 60 positioned into the locking channel, both connectors 31 and 32 are rigidly secured together as is better illustrated in FIG. 3.

FIG. 3 shows a preferred embodiment of the construction of the connectors when utilized as a joint for reinforced concrete pile sections having a hexagonal cross-section. As hereinshown, reinforcing rods 70 are welded on the rear face 71 of each plate 45 and 35. Skirts 73 are also welded about the edge of the rear wall 71 of each connector plate whereby to facilitate attachment of the connectors to the ends of concrete piles during the formation of same. A vent hole 74 is provided in each skirt 73.

A steel pin 75 may be located into a cavity 76 which may be provided in the projection portion 46 to add further lateral stability to the joint formed when both connectors are in a mating position. A hole 77 would also be provided in the flat wall of the connector 31 for receiving an end of the pin 76. This pin is, of course, inserted before the connectors are placed in a mating position whereby to facilitate alignment of same.

Although the locking rod 60 is hereinshown as having a square cross-section as is the cross-section of the locking channel, it is foreseen that the locking rod 60 may have a rectangular cross-section as well as the cross-section of locking channel. Also, although the connector structure is hereindescribed for interconnecting pile sections, it is foreseen that one of the connectors could be secured in a ground anchorage structure, such as a concrete bed, for attachment of a post-like structure having the other connector secured to an end thereof. This would facilitate installation or replacement of such post structure should it be damaged or should it be required to be removed for other reasons. The connectors would provide easy removal and a rigid joint. For example, the connector could be used for securing lamp posts, posts utilized for signs, and can be utilized with permanent or temporary installations. Still further, these connectors could be used for ramp posts which are normally provided along roadways and these posts would be easily replaceable when damaged by vehicles.

By utilizing a locking rod having a square cross-section, the resistance of the joint is greatly increased when compared to an identical locking rod having a circular cross-section. As previously discussed the peripheral flange 36 of the female connector which is the portion which has a tendency to bend outwardly, as shown in FIG. 1A is required to be of a larger thickness when utilized with a circular locking rod. By having the flange 11 of a greater thickness, the diameter $D_t$ (FIG. 1A) of the locking rod about the locking channel must be reduced and, therefore, the shear resistance of the rod is also reduced for the reason that the shear resistance is established by the following formula.

$$R = fc \times \pi.d.D_t - R - \textit{shear resistance}$$

$fc$ —shear resistance of a steel locking rod = lb/in²
$d$—diameter of the rod
$D_t$—diameter of the locking channel Thus, it can be seen that the greater the thickness of the flange 36 or 12 of the female connector, the more the diameter $D_t$ is reduced and the more the internal shear resistance of the joint is reduced.

When utilizing a locking rod having a square or rectangular cross-section the traction force is applied against both horizontal opposed surfaces of the locking rod 60 and the resultant force is maintained substantially along the longitudinal axis 65 of the joint.

I claim:

1. A connector structure for interconnecting elongated pile sections comprising a first connector element for securement to the end of a pile section, a second connector element for securement to a further pile section, one of said connectors having a plate for attachment to one of said sections, an annular flange located on and extending above a surface of said plate to define a connecting inner side wall extending parallel to the longitudinal axis of said pile sections, a flat top surface on said flange, an inner recess area defined by said flange and having a flat bottom wall, a groove mid-way about said inner connecting side wall, the other of said connectors having a further plate for attachment to said other one of said sections; a projection portion extending above a surface of said further plate and having a flat top surface, said projection portion being of the same thickness as the height of said annular flange and defining a connecting outer side wall also extending parallel to the longitudinal axis of said pile sections, a groove mid-way about said outer side wall, said projection portion being dimensioned for close fit within said inner recess area with said grooves juxtaposed and said flat top surface of said projection portion in abutment with said recess area bottom wall, said juxtaposed grooves defining an endless locking channel of square cross-section, at least one access passage extending through said flange to join said locking channel tangentially to permit passage and insertion of a locking rod at least in a substantial portion of said locking channel, said rod having a square cross-section for close fit into said locking channel whereby it can be fitted in said channel through said access passage to lock the connectors from separation, said locking rod and said channel having opposed parallel top and bottom surfaces disposed transversely to the longitudinal axis of the pile and parallel side surfaces extending parallel to said longitudinal axis to provide axial load transfer between said groove top and bottom surfaces when a load is applied axially of said pile sections and acting between said opposed parallel faces of said rod in said axial direction.

2. A connector structure as claimed in claim 1 wherein said elongated pile sections are formed of reinforced concrete.

3. A connector structure as claimed in claim 1 wherein said connector element is secured in a ground anchorage structure whereby to support said post-like structure thereabove.

4. A connector structure as claimed in claim 1 wherein said annular flange extends about the periphery of said plate, said plate being flat and of substantially the same diameter as said end of said post-like structure.

5. A connector structure as claimed in claim 1 wherein said first and second connector elements and said locking rod are constructed metal.

6. A connector as claimed in claim 1, wherein said groove in said inner connection side wall and in said outer side wall are of the equal depth whereby said locking rod extends substantially an equal amount in each groove to provide substantially equal distribution of load transfer between said groove top and bottom surfaces.

* * * * *